United States Patent [19]

Poe et al.

[11] 4,213,642

[45] Jul. 22, 1980

[54] ROTARY LATCH AND METHOD OF OPERATION

[75] Inventors: L. Richard Poe, Long Beach; William R. Bourne, Redondo Beach, both of Calif.

[73] Assignee: Hartwell Corporation, Placentia, Calif.

[21] Appl. No.: 11,193

[22] Filed: Feb. 12, 1979

[51] Int. Cl.[2] ..... E05C 3/04

[52] U.S. Cl. ..... 292/241; 70/432

[58] Field of Search ..... 292/240, 241, 101-106; 70/432

[56] References Cited

U.S. PATENT DOCUMENTS

| | | | |
|---|---|---|---|
| 2,919,569 | 1/1960 | Davis | 70/432 X |
| 3,254,517 | 6/1966 | Wheeler | 292/240 X |
| 3,503,642 | 3/1970 | Poe | 70/432 X |
| 3,907,348 | 9/1975 | Bates et al. | 292/241 X |

*Primary Examiner*—Richard E. Moore

*Attorney, Agent, or Firm*—Lyon & Lyon

[57] ABSTRACT

A rotary latch and its method of operation, the latch being caused to move between a position flush with a surrounding surface and a protruding position as the latch is moved between its latched position and its unlatched position, a rotary drive means, by reason of its protruding position, being readily visible to indicate the unlatched condition; the rotary drive means including a control sleeve having radially outwardly facing detent pockets engaged by a radially movable pin, one socket being engaged when the latch is in its flush-latched condition, second socket being engaged when in its fully unlatched condition, and a third socket being engaged as a secondary latch.

9 Claims, 7 Drawing Figures

ROTARY LATCH AND METHOD OF OPERATION

BACKGROUND OF THE INVENTION AND SUMMARY OF THE PRIOR ART

The instant application is directed to a rotary latch for latching and securing panels such as those utilized on air craft.

Prior devices have been utilized in order to indicate whether or not a latch is secure, see for example, my U.S. Pat. No. 3,503,642. However, existing latches may not protrude yet not be latched in that the latching mechanism is not completely latched but approaches the latched position. A significant problem associated with such latches is the possibility of the latch becoming unsecured due, for example, to vibration during operation when it is difficult, if not impossible, to resecure the latch.

Figure 1:
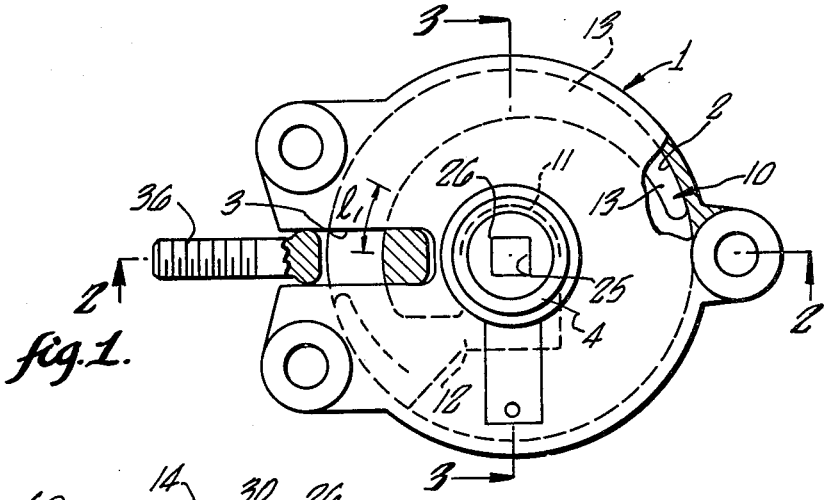
FIG. 1 is a plan view of the flush latch shown in its locked condition, the keeper being shown in section.

The flush type rotary drive for latches includes a body 1 having a cylindrical recess 2 at its underside intersected by a radial keeper slot 3. Centered with respect to the cylindrical recess 2 and extending upwardly from the body 1 is an integral sleeve 4. The extended end of the sleeve 4 is reduced in external diameter, as indicated by 5, and is received in an opening provided in panel 6 or other mounting member so that the outer extremity of the sleeve 4 is flush therewith. The body 1 is provided with a counterbore 7 coaxial with the sleeve 4. The underside of the body 1 is provided with a bottom cover plate 8 having a radial channel 9 coinsiding with the slot 3.

Received in the recess 2 is a hook type latch 10. As shown in FIG. 1, the latch 10 includes a journal hub 11, a connecting portion 12 joined to a hook latch arm 13 occupying approximately a half circle and tapering from the radial portion 12 towards its extremity, such that the radius of curvatures decreases to a constant radius portion at the extremity labeled $1_1$.

Figure 5:
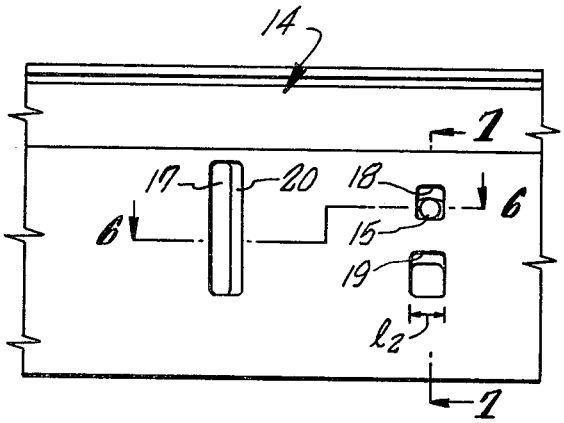
FIG. 5 is a developed view of the portion control sleeve showing the retainer sockets therein.
Figure 6:
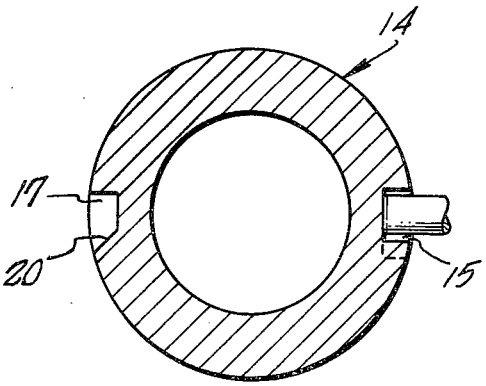
FIG. 6 is an enlarged transverse sectional view of the control sleeve taken through 6—6 of FIG. 5.
Figure 7:
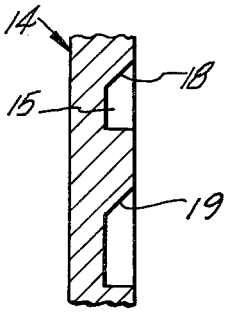
FIG. 7 is an enlarged fragmentary longitudinal view of the control sleeve taken through 7—7 of FIG. 5.

Received in the sleeve 4 is an inner control sleeve 14 having in its radially outer surface a primary locking socket 15 and a secondary locking socket 16 spaced inwardly therefrom, an open position retension socket 17, spaced circumferentially therefrom, their relative positions being shown in FIGS. 5, 6 and 7. The axially outward margins of sockts 15 and 16 have cam faces 189 and 19, whereas the socket 17, which is in the form of an axial channel, is provided with a circumferential cam face 20. Formed on the body is a radial boss 21 having a radial bore 22 which receives a pin 23 backed by a spring 24, which protrudes through the wall of the sleeve 4 and selectively engages the sockets 15, 16 and 17. The width of the secondary locking socket 16, $1_2$, $1_2$ minus the diameter of pin 23 is less than the constant radius portion of the hook latch 13. Accordingly, should the pin 23 not fully engage socket 15 and become engaged in the secondary locking socket 16, the control sleeve 14 is prevented from rotating an amount sufficient to allow the device to unlatch. As shown in FIG. 5, secondary latching socket 16 has substantially the same center line as socket 15, socket 16 being slightly displaced in the direction of rotation toward socket 17.

The upper portion of the inner or control sleeve 14 is provided with a square bore 25 which receives a square closure pin 26. The inner end of the bore 25 terminates in a shoulder 28 and the inner end of the closure pin 26 is provided with a head 29 which bears against the shoulder 28. The closure pin 26 is provided with a socket, accessible through the head 29, which receives a spring 30. The spring 30 receives a guide pin 31 having a head 32 which engages a cross bar 33. The ends of the cross bar 33 extend through the walls of the sleeve 14 and are received in vertical slots 34 disposed 180° apart and extend upwardly through the upper end of the hook latch hub 11, thereby forming a drive connection between the control sleeve 14 and the hook latch 10. Interposed between the cross bar 33 and the cover plate 8 is a spring 35.

The radial slot 3 and hook latch 10 are dimensioned to receive a loop type keeper 36 which, in itself, may be considered as conventional.

Figure 2:
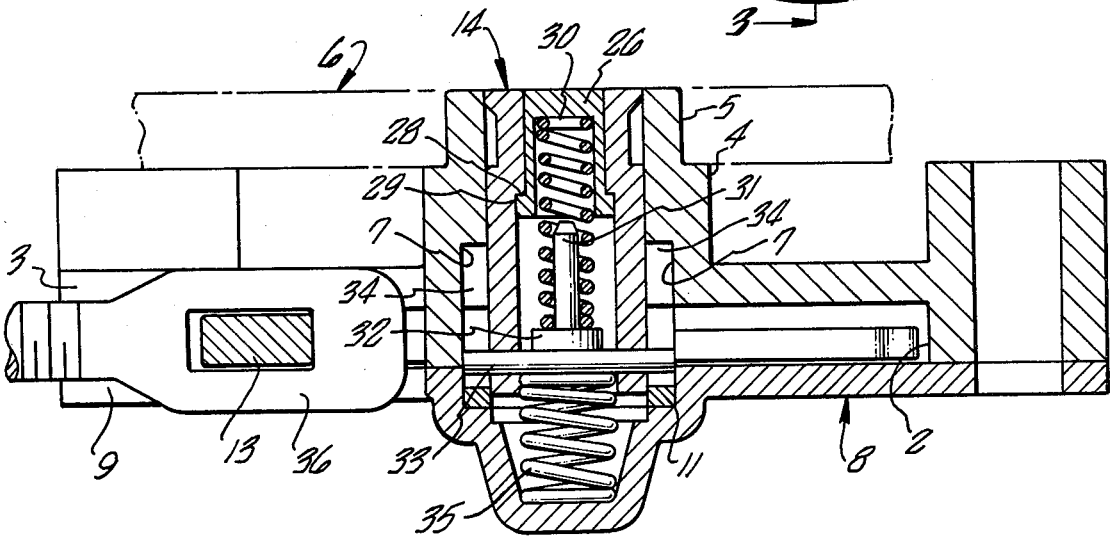
FIGS. 2 and 3 are enlarged sectional views taken through 2—2 and 3—3 respectively, with portions shown in elevation.

Operation of the rotary latch drive is as follows:

When the keeper 36 is secured in position by the hook latch 10, the various parts are in the position shown in FIGS. 1 and 2. Both the control sleeve 14 and the closure pin 26 are flush with the upper end of the sleeve 4, and thus flush with the surface of the panel 6.

To operate the latch, a polygonal tool 37 is forced into the bore and turned either to withdraw the hook latch 13 from the position shown in FIGS. 1 and 2 or to move the hook latch in the opposite direction if the hook latch and keeper are disengaged. When the latch is in its secured position shown in FIGS. 1 and 2, the pin 23 is in the socket 15 held therein by the force of the spring 24. Also the bottom or inner wall of the socket 15 engages the pin 23 to position the outer face of the control sleeve flush with the surface of sleeve 4.

Figure 3:
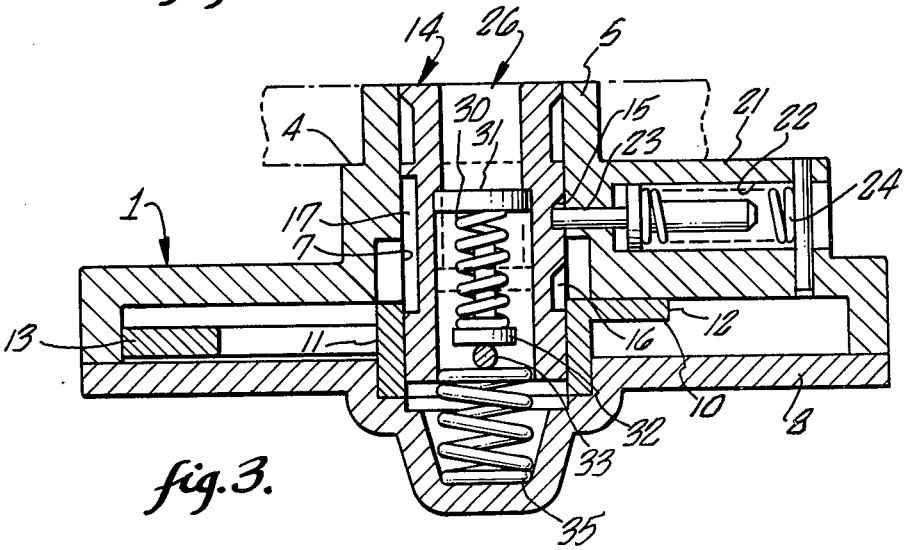
Figure 4:
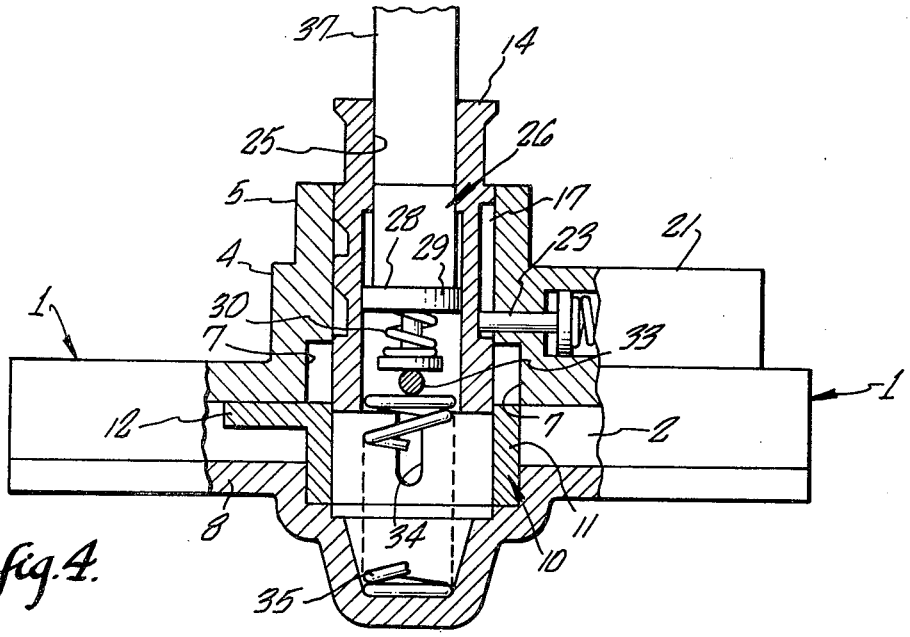
FIG. 4 is a partial sectional, partial elevational view corresponding to FIG. 3 with parts shown in their unlatched condition.

In order to initiate movement from the locked condition represented in FIGS. 2 and 3, the control sleeve must be pressed inwardly a short distance, in order to remove the cam pin 23 from the socket 15. Such inward movement of the control sleeve 14 causes the pin 23 to move radially and axially over the cam face 18. One disengaged from the socket 15, latch hook 13 may be readily disengaged as the cam pin 23 rides peripherally on the surface of the control sleeve 14 which is urged by spring force from its flush position and allowed to rise above the outer sleeve 4 until the keeper 36 is completely disengaged as indicated in FIG. 4 and the pin 23 enters the axially extended socket 17, causing the cam pin 23 to detent the latch in its released condition.

The axial extent of the socket 17 is equal to the full travel of the control sleeve 14 so that irrespective of axial movement of the control sleeve, the pin 23 is retained and the latch remains unlocked. In order to lock the latch, an initial rotating force must be applied to force the pin 23 over the cam surface 20.

Should the control sleeve 14 become extended, when the latch is locked, the latch remains locked and the pin 23 is received in the locking socket 16 until inward force is applied to control sleeve to cause the pin 23 to ride over the cam face 19. The peripheral dimension of the socket 16 is increased so that the socket 16 will be engaged even though the latch is not in its fully rotated position.

In order to render the control sleeve 14 more conspicuous when in its extended position, the outer portion of the sleeve 14 is provided with a circular channel 14*a* which is given a conspicuous coating. The channel does not come in contact with any surface so that such coating is well protected.

Having fully described our invention, it is to be understood that we are not to be limited to the details herein set forth, but that our invention is of the full scope of the appended claims.

We claim:

1. A rotary latch for engaging a panel comprising:

rotatable means for latching and unlatching a keeper carried by said panel;

control sleeve means for axially sliding between a first retracted position, in which the outer surface of said control sleeve means is flush with said panel, and a second protruding position, in which said outer surface of said control sleeve means protrudes from said panel;

means for operatively connecting said rotatable means for latching and said control sleeve means;

means for restraining said control sleeve means in said first retracted position and restraining said rotatable means in a latching position;

means for restraining said control sleeve means in said second protruding position and for restraining said rotatable means in an unlatching position upon rotation of said control sleeve means; and means for secondarily restraining said control sleeve means and restraining said rotatable means in said latching position.

2. The rotary latch claimed in claim 1 wherein said means for restraining said control sleeve in said first retracted position and restraining said rotatable means in a latching position is further defined as including a latch pin urged into a first socket; said means for restraining said control sleeve means in said second protracted position and for restraining said rotatable means in an unlatching position upon rotation of said control sleeve means is further defined as including a second socket; and said means for secondarily restraining said control sleeve and restraining said rotatable means in said latching position is further defined as including a third socket.

3. The rotary latch claimed in claim 2 wherein said rotatable means for latching and unlatching includes a hook shaped member having a constant radius portion at said latching position and an increasing radius of curvature between said latching position and said unlatching position; and wherein the peripheral length of said constant radius position is greater than the lateral width of said second socket means less the diameter of said latch pin.

4. The rotary latch claimed in claim 2 wherein said first socket is slightly larger than said latch pin, said first socket being further defined as being substantially rectangular in configuration with the straight parallel side walls.

5. The rotary latch claimed in claim 2 wherein said first second and third sockets are all positioned about the periphery of said control sleeve means and the center line of said first and third sockets are substantially coincidental

6. A rotary latch for engaging a panel comprising:

rotatable means for latching and unlatching a keeper carried by said panel;

control sleeve means for axially sliding between a first retracted position, in which the outer surface of said control sleeve means is flush with said panel, and a second protruding position, in which said outer surface of said control sleeve means protrudes from said panel;

means for operatively connecting said rotatable means for latching and said control sleeve means;

a latch pin urged into a first socket for restraining said control sleeve means in said first retracted position and restraining said rotatable means in a latching position;

a second socket for restraining said control sleeve means in said second protruding position and for restraining said rotatable means in an unlatching position upon rotation of said control sleeve means; and a third socket for secondarily restraining said control sleeve means and restraining said rotatable means in said latching position wherein said rotatable means for latching and unlatching includes a hook shaped member having a constant radius portion at said latching position and an increasing radius of curvature between said latching position and said unlatching position; and wherein the peripheral length of said constant radius position is greater than the lateral width of said second socket means less the diameter of said latch pin.

7. The rotary latch claimed in claim 6 wherein said first socket is slightly larger than said latch pin, said first socket being further defined as being substantially rectangular in configuration with the straight parallel side walls.

8. The rotary latch claimed in claim 6 wherein said first second and third sockets are all positioned about the periphery of said control sleeve means and the center line of said first and third sockets are substantially coincidental.

9. A method for latching and unlatching a keeper carried in a panel comprising:

rotating and axially sliding, axially, a control sleeve between a first retracted position, in which the outer surface of said control sleeve means is flush with said panel, and a second protruding position, in which said outer surface of said control sleeve means protrudes from said panel upon rotating of said control sleeve means;

restraining said control sleeve means in said first retracted position and restraining said control sleeve in a latching position;

restraining said control sleeve means in said second protruding position and for restraining said control sleeve in an unlatching position upon rotating of said control sleeve means; and restraining, secondarily, said control sleeve means and restraining said control sleeve in said latching position upon failure of restoring of said control sleeve in said first retracted position.

* * * * *